US011089863B2

(12) United States Patent
Alinski

(10) Patent No.: US 11,089,863 B2
(45) Date of Patent: Aug. 17, 2021

(54) TUFT PICKER FOR A BRUSH MAKING MACHINE

(71) Applicant: The Procter & Gamble Company, Cincinnati, OH (US)

(72) Inventor: Jens Alinski, Kelkheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 93 days.

(21) Appl. No.: 16/449,905

(22) Filed: Jun. 24, 2019

(65) Prior Publication Data

US 2019/0307241 A1 Oct. 10, 2019

Related U.S. Application Data

(63) Continuation of application No. PCT/US2018/014412, filed on Jan. 19, 2018.

(30) Foreign Application Priority Data

Jan. 24, 2017 (EP) ..... 17152768

(51) Int. Cl.

| | |
|---|---|
| ***A46D 1/08*** | (2006.01) |
| ***A46D 3/08*** | (2006.01) |
| ***A46D 1/00*** | (2006.01) |
| *A46B 9/04* | (2006.01) |

(52) U.S. Cl.

CPC ..... *A46D 3/082* (2013.01); *A46D 1/0238* (2013.01); *A46D 1/0269* (2013.01); *A46D 1/08* (2013.01); *A46B 9/04* (2013.01); *A46B 2200/1066* (2013.01)

(58) Field of Classification Search

CPC ..... A46D 1/0238; A46D 1/08; A46D 3/082

See application file for complete search history.

(56) References Cited

U.S. PATENT DOCUMENTS

| | | | |
|---|---|---|---|
| 1,664,424 | A | 4/1928 | Conrad |
| 2,349,532 | A | 5/1944 | West |
| 3,167,355 | A | 1/1965 | Aldrich |
| 3,606,472 | A | 9/1971 | Rutkowski |
| 4,174,029 | A | 11/1979 | Kawaguchi et al. |

(Continued)

FOREIGN PATENT DOCUMENTS

| | | |
|---|---|---|
| BE | 765338 | 8/1971 |
| CN | 201468419 | 5/2010 |

(Continued)

OTHER PUBLICATIONS

PCT/US2018/014412 International Search Report with written opinion, dated May 17, 2018, 11 pages.

(Continued)

*Primary Examiner* — Randall E Chin

(74) *Attorney, Agent, or Firm* — Vladimir Vitenberg

(57) ABSTRACT

A tuft picker for a brush-making machine for automated production of brushes, toothbrushes adapted to remove filaments from a filament container. The tuft picker includes two cover tools spaced by a picking part. The picking part has at least one picker eye for taking up a predefined number of loose filaments from the filament container. This picker eye has an opening that can be opened and closed by moving the cover tools from a first position to a second position during one working stroke.

15 Claims, 6 Drawing Sheets

(56) References Cited

U.S. PATENT DOCUMENTS

| | | | | |
|---|---|---|---|---|
| 4,603,913 | A * | 8/1986 | Dorflinger | A46D 3/082 300/7 |
| 4,647,113 | A * | 3/1987 | Steinebrunner | A46D 3/082 300/21 |
| 4,733,917 | A | 3/1988 | Boucherie | |
| 4,968,102 | A | 11/1990 | Boucherie | |
| 5,033,797 | A | 7/1991 | Rueb | |
| 5,165,759 | A | 11/1992 | Lewis, Jr. | |
| 5,344,218 | A | 9/1994 | Weihrauch | |
| 5,728,408 | A | 3/1998 | Boucherie | |
| 6,079,788 | A | 6/2000 | Boucherie | |
| 6,086,373 | A | 7/2000 | Schiff | |
| 6,138,314 | A | 10/2000 | Schiff | |
| 6,290,302 | B1 | 9/2001 | Boucherie et al. | |
| 6,290,303 | B1 | 9/2001 | Boucherie | |
| 6,905,176 | B2 | 6/2005 | Boucherie | |
| 7,635,169 | B2 | 12/2009 | Boucherie | |
| 8,172,336 | B2 | 5/2012 | Boucherie | |
| 9,192,227 | B2 | 11/2015 | Stein et al. | |
| 10,398,220 | B2 | 9/2019 | Alinski | |
| 2001/0026093 | A1 | 10/2001 | Boucherie | |
| 2004/0164604 | A1 | 8/2004 | Boucherie | |
| 2005/0116528 | A1 | 6/2005 | Boucherie | |
| 2007/0145812 | A1 * | 6/2007 | Boucherie | A46D 3/082 300/8 |
| 2010/0066154 | A1 | 3/2010 | Boucherie | |
| 2012/0013169 | A1 | 1/2012 | Rees | |
| 2013/0038115 | A1 | 2/2013 | Stein et al. | |
| 2016/0157599 | A1 | 6/2016 | Kumpf et al. | |
| 2017/0065072 | A1 | 3/2017 | Alinski | |
| 2017/0065073 | A1 | 3/2017 | Alinski | |
| 2019/0374020 | A1 | 12/2019 | Alinski | |

FOREIGN PATENT DOCUMENTS

| | | | |
|---|---|---|---|
| CN | 201468429 | U | 5/2010 |
| CN | 201468430 | U | 5/2010 |
| CN | 102481047 | A | 5/2012 |
| CN | 103298370 | A | 9/2013 |
| DE | 2128774 | | 10/1972 |
| DE | 3016790 | | 11/1981 |
| DE | 4040297 | | 6/1992 |
| DE | 4411652 | | 10/1995 |
| DE | 19728442 | | 1/1999 |
| DE | 19745024 | | 4/1999 |
| DE | 19939333 | | 2/2001 |
| DE | 20319767 | | 6/2005 |
| DE | 102005045827 | | 3/2007 |
| DE | 102005056968 | | 5/2007 |
| DE | 102007047066 | | 4/2009 |
| DE | 102008059121 | | 5/2010 |
| EP | 0016508 | | 10/1980 |
| EP | 0206385 | | 12/1986 |
| EP | 0289676 | | 11/1988 |
| EP | 0346965 | | 12/1989 |
| EP | 0432868 | | 6/1991 |
| EP | 0681796 | | 11/1995 |
| EP | 0916283 | | 5/1999 |
| EP | 1522234 | | 4/2005 |
| EP | 2654501 | | 10/2013 |
| GB | 418967 | | 11/1934 |
| GB | 1146518 | | 3/1969 |
| JP | 05015412 | | 1/1993 |
| JP | 06277119 | | 10/1994 |
| JP | 2003169719 | | 6/2003 |
| WO | WO200010814 | | 3/2000 |
| WO | WO200949850 | | 4/2009 |
| WO | 2010021138 | A1 | 2/2010 |
| WO | 2013024851 | A1 | 2/2013 |
| WO | 2014050863 | A1 | 4/2014 |

OTHER PUBLICATIONS

All Office Actions, U.S. Appl. No. 16/449,801 (Undated).
Extended European Search Report and Search Opinion; Application Ser. No. 17152768.2; dated Jul. 27, 2017; 7 pages.

* cited by examiner

TUFT PICKER FOR A BRUSH MAKING MACHINE

FIELD OF THE INVENTION

There is provided a tuft picker for a brush making machine for automated production of brushes, in particular toothbrushes. The tuft picker is adapted to remove filaments from a filament container which provides multiple loose filaments. The tuft picker as disclosed herein comprises a picking part and two cover tools, wherein the cover tools are spaced by the picking part. The picking part comprises at least one picker eye for taking up a predefined number of loose filaments from the filament container. The picker eye comprises an opening which can be opened and closed by moving the cover tools from a first position into a second position. During one working stroke of the tuft picker the working surface of the picking part comprising the at least one picker eye is transferred along the loose filaments twice, wherein the opening of the picker eye is open during the first passing and closed during the reverse movement of the tuft picker. Thereby, the filaments located in the picker eye are securely stored in the space of the picker eye and covered against mechanical abrasion and wear.

BACKGROUND OF THE INVENTION

The bristle field of modern toothbrushes comprises multiple filament tufts. A filament tuft comprises a predefined number of individual filaments which are arranged to each other with parallel length axes. During manufacturing of toothbrushes these filament tufts are separated from a filament reservoir, also known as filament container, comprising a plurality of filaments loosely arranged with parallel length axes. One side of the filament container is open or comprises an opening so that the filaments can be transferred continuously against said opening. At the opening the filaments can be taken out by a tuft picker. Said tuft picker comprise a picking part that comprises at least one picker eye which dimension is identical to the dimension of the filament tuft to be produced. Different tuft pickers are known in the state of the art, e.g. devices comprising picker eyes of different size (U.S. Pat. No. 7,635,169B2) or shape (US 2013/0038115 A1). Although these devices are used as standard in toothbrush manufacturing techniques, the filaments undergo wear, tension and mechanical stress. These problem including the damage to the filaments significantly increase, if non-standard filaments shall be used which do not comprise a more or less homogeneous surface and diameter over the whole length or are significantly thinner than the standard filaments.

Toothbrush development focusses on cleaning performance looking continuously for new filaments with a different cleaning property compared to the standard round filaments. Nowadays, irregular filaments, in particular filaments comprising depressions, recesses or the like along their length axes came into fashion as these filaments take up the removed dust and complement during cleaning performance. Prominent examples for said new kind of filaments are X-shaped filaments. Another example of irregular filaments is a tapered filament, which ends become significantly thinner in order to provide a cleaning performance comparable to the use of floss. For the same reason super-thin filaments may also be used.

Unfortunately, none of the latter filaments can be processed properly with the present manufacturing devices in particular the picking process does not work properly for these filaments. The problems are inter alia splicing of filaments, picking different numbers of filaments up to picking no filaments and/or loosing picked filaments after having picked them so that filament tufts of non-standard filaments cannot be formed properly at the moment. In particular splicing of filaments causes problems for the final toothbrush as sharp edges might hurt the gum of the toothbrush user.

Thus, a need exists for a new tuft picker which is adapted to pick non-standard filaments and reduces mechanical stress to standard filaments and the devices used during the picking process. Thus, it is the object of the present application to provide such a new tuft picker which picks non-standard filaments, such as X-shaped filaments, tapered filaments or super-thin filaments, with a high operational reliability regarding number of filaments and without any splicing.

SUMMARY OF THE INVENTION

In accordance with one aspect, there is provided a tuft picker comprising a picking part comprising at least one picker eye with an opening in a working surface of the picking part and a bottom opposite of the opening;

a first cover tool and a second cover tool which are spaced by the picking part, wherein the first and second cover tool each comprises a hook which is connected by a spacer to a main body, wherein the hook comprises a first surface which form corresponds to the working surface of the picking part at the opening and wherein the hooks are located at identical positions relative to the picking part; and wherein the cover tools are movable relative to the picker eye from a first position to a second position, wherein the hooks are located outside the picker eye in the first position of the cover tools and are located in the second position of the cover tools in such that they limit the picker eye at the building line of the opening.

In accordance with another aspect, there is provided a brush making machine comprising a tuft picker as disclosed herein.

In accordance with another aspect, there is provided a method of providing filament tufts comprising a predefined number of filaments for the manufacturing of brushes, in particular toothbrushes, using preferably a tuft picker as disclosed herein. The method comprises:

- providing filaments in a filament container, wherein the filaments are continuously transferred against an open side of the filament container;
- passing at least one opening of at least one picker eye of a tuft picker along the open side of the filament container in order to let filaments being transferred from the container into the picker eye;
- removing filaments from the opening of the at least one picker eye by sliding hooks of the cover tools of the tuft picker from their first position into their second position; and
- transferring the filaments located in the closed picker eye to a removal device, which removes the filaments from the picker eye.

The method as disclosed herein is in particular suitable for non-standard filaments. Thus, in accordance with another aspect, there is provided a brush, in particular a toothbrush, comprising at least on filament tuft comprising at least one non-standard filament.

BRIEF DESCRIPTION OF DRAWINGS

These and other features will become apparent not only from the claims but also from the following description and the drawings, with the aid of which example embodiments are explained below.

DETAILED DESCRIPTION OF THE INVENTION

Figure 1:
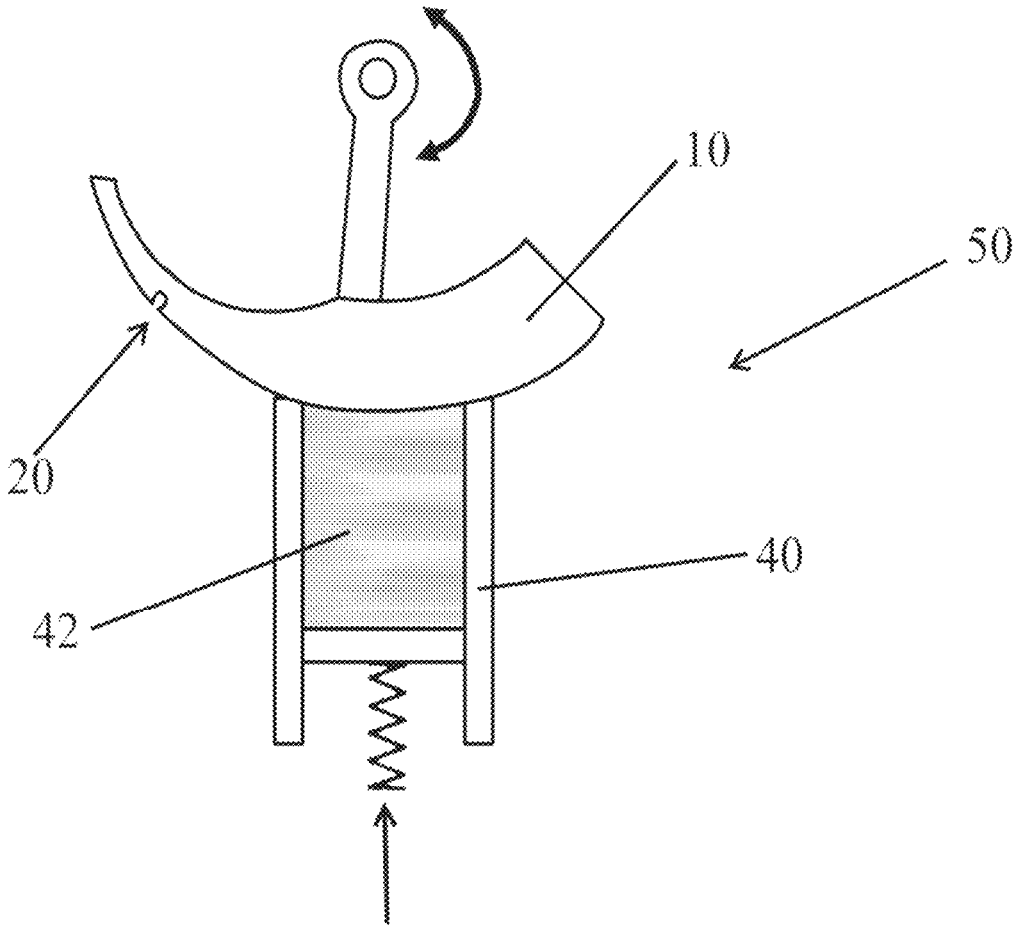
FIG. 1 shows a schematic sketch of a tuft picking device 50 for brush making machines comprising a tuft picker 10 with a picker eye 20.

The following is a description of numerous versions of a tuft picker comprising a tuft picker suitable to provide standard and non-standard filaments, such as shaped filaments, in particular X-shaped filaments, tapered filaments or super-thin filaments for brush production, in particular for toothbrush production. The description further discloses a method using said tuft picker which can be used to produce (tooth)brushes and the produced toothbrushes themselves. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein. In addition, single features or (sub)combinations of features may have inventive character irrespective of the feature combination provided by the claims, the respective part of the specification or the drawings.

By "cm" as used herein is meant centimeter. By "mm" as used herein is meant millimeter. By "μm" or "microns" as used herein is meant micrometer. By "mil" as used herein is meant a thousandth of an inch.

As used herein, the word "about" means +/−10 percent.

As used herein, the word "comprise," and its variants, are intended to be non-limiting, such that recitation of items in a list is not to the exclusion of other like items that may also be useful in the materials, devices, and methods of this invention. This term encompasses the terms "consisting of" and "consisting essentially of".

As used herein, the word "include," and its variants, are intended to be non-limiting, such that recitation of items in a list is not to the exclusion of other like items that may also be useful in the materials, devices, and methods of this invention.

As used herein, the words "preferred", "preferably" and variants, such as "in particular" and "particularly" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

There is provided a tuft picker for a brush making machine. The tuft picker is able to pick a predefined number of filaments from a filament container which provides a supply of loose filaments in a mutually parallel condition. The circumference of the loose filaments may substantially round or the circumference may comprise at least one recess or may alter along the length axis of the filaments. A "filament container" as understood herein shall comprise any container of any geometrical shape which is suitable to store the loose filaments in parallel. A plurality of filaments is arranged in the filament container along their length axis. That means each filament element is arranged with its length axis in parallel to the adjacent filaments. The filament container comprises one open side or an opening is present in one side wall. At that opening the filaments are exposed to the environment, in particular are exposed to a tuft picker as disclosed herein and can be removed from the filament container by said tuft picker. Opposite to the opening of the filament container a plunger etc. might be arranged which continuously presses the loose filaments against the open side of the filament container.

Filaments may be for example monofilaments made from plastic material. Suitable plastic material used for filaments may be polyamide (PA), in particular nylon, polybutylterephthalate (PBT), polyethylterephthalate (PET) or mixtures thereof. In addition, the filament material may comprise additives such as abrasives, color pigments, flavors etc. For example an abrasive such as kaolin clay may be added and/or the filaments may be colored at the outer surface in order to realize indicator material. The coloring on the outside of the material is slowly worn away during use to indicate the extent to which the filament is worn. Suitable additives to filaments used for tuft filaments are for example UV-brighteners, signaling substances, such as the indicator color pigments and/or abrasives. The diameter of the filament may be in the range from about 0.1 mm to about 0.5 mm, in particular in the range from about 0.15 to about 0.4 mm, more particular in the range of about 0.18 mm to about 0.35 mm or any other numerical range which is narrower and which falls within such broader numerical range, as if such narrower numerical ranges were all expressly written herein.

In addition, to the standard filaments having the diameters as given above super-thin filaments are used in toothbrushes. Super-thin filaments have a smaller diameter compared to standard filaments and may act like floss during normal brushing. The diameter of super-thin filaments may be in the range from about 0.05 mm to about 0.15 mm, in particular in the range from about 0.07 mm to about 0.13 mm, more particular in the range of about 0.09 mm to about 0.11 mm or any other numerical range which is narrower and which falls within such broader numerical range, as if such narrower numerical ranges were all expressly written herein. Filament diameters are produced with a tolerance of 10%.

In addition to filaments with a substantially constant diameter filaments may also be used which diameter decreases towards the ends. These kind of tapered filaments are based on standard diameter filaments which ends are chemically tapered. Suitable tapered filaments are provided for example by BBC, Korea.

In addition, filaments may be used for toothbrushes which comprise an irregular diameter, i.e. which comprise at least one recess. A "recess" as understood herein in the filament circumference, diameter and/or volume shall mean any depression, cavity, slot or other geometric recess which amends the filament volume. The filament comprising at least one recess in its circumference may comprise one or more recesses along the circumference of the filament. A suitable example for a filament comprising at least one recess is an X-shaped filament. X-shaped filaments comprise four recesses and two lines of reflection symmetry each crossing two recesses which are located opposite to each other. In addition, all four recesses might be equal. The included angle of the X-shape filaments might be in the range of from about 40° to about 160°. Length of the filaments depends on the intended use. Generally, a filament can be of any suitable length for transporting, such as about 1300 mm and is then cut into pieces of the desired length. The length of a filament in a toothbrush influences the bending forces needed to bend the filament. Thus, the length of a filament can be used to realize different stiffness of filaments in a brush pattern. The typical length of a filament for a brush, in particular a toothbrush, may be in the range from about 5 mm to about 18 mm, in particular in the range from about 6 mm to about 15 mm, more particular in the range of about 7 mm to about 13 mm or any other numerical range which is narrower and which falls within such broader numerical range, as if such narrower numerical ranges were all expressly written herein. The filaments to be picked with a tuft picker as disclosed herein may be mounted to a brush by anchor wires. These filaments typically have a doubled length compared to the filaments which are mounted to a brush by anchor free techniques. In addition the filaments may be longer than the final filament length in the resulting brush head so that the filaments can be cut to different specific final lengths after picking them. The filaments to be picked may be longer than the final filaments in the range from about 0.5 mm to about 5 mm, in particular in the range from about 1 mm to about 4 mm, more particular in the range of about 1.5 mm to about 3 mm or any other numerical range which is narrower and which falls within such broader numerical range, as if such narrower numerical ranges were all expressly written herein. In particular, if the brushes are manufactured by anchor technology all filament tufts are mounted into the brush head first and then the filaments are cut into their final length. After cutting the cut ends are end-rounded in order to remove the sharp ends which could hurt the gums of the user of the brush. The process of end-rounding comprises several successive polishing steps, preferably using decreasing abrasiveness. If tapered filaments or super-thin filaments shall be used the standard filaments are cut into length and are end-rounded first before the tapered or the super-thin filaments may be mounted to the brush in order not to alter the ends of the tapered or super-thin filaments. Alternatively, the tapered or super-thin filaments may be bent away during cutting and end-rounding of the standard filaments.

The filaments in a brush head, in particular in a toothbrush head, are grouped in filament tufts. A suitable number of filaments to form one filament tuft may be for example in the range of about 10 to about 80, or in the range of about 15 to about 60, or in the range of about 20 to about 50, or any other numerical range which is narrower and which falls within such broader numerical range, as if such narrower numerical ranges were all expressly written herein. The predefined number of filaments which shall form one filament tuft is separated from the filament container mechanically, i.e. by a picking process, in particular by a picking process as disclosed herein.

"Picking" as understood herein shall mean that filaments are pushed perpendicular to their length axis continuously from a filament container in the direction of a tuft picker as disclosed herein, wherein the tuft picker comprises at least one picker eye able to accept the predefined number of filaments. The picked number of filaments, named filament tuft, is then transferred to a brush making machine and mounted into a brush head.

A "tuft picker" as disclosed herein comprises a picking part, which comprises a working surface comprising at least one picker eye. Said at least one picker eye is a recess along the working surface, thus comprising a depth, a width along the depth and an opening in/at the working surface of the picking part of the tuft picker. A bottom of the picker eye is the deepest part of the recess which is usually located opposite to the opening of the picker eye.

At both sides of the picking part of the tuft picker a cover tool is arranged. Each cover tool comprises a hook which is connected by a spacer to a main body. The hook of each cover tool comprises a first and a second surface, wherein the form of the first surface corresponds to the form of the working surface of the picking part at the opening of the picker eye. In addition, the main bodies of the cover tools are movably arranged at the picking part of the tuft picker, in particular the cover tools are movable relative to the picker eye. In a first position of the cover tools the hook is located outside the picker eye. In a second position the cover tools are located in such that the hooks limit the picker eye at the building line of the working surface. That means the picker eye is still open in the layer of the picking part, but the picker eye is closed by the adjacent cover tools to both sides. If the picker eye is filled with filaments during a picking process, one end of the filaments will protrude from the cover tool at one side of the picking part of the tuft picker and the other end of the filaments will protrude from the cover tool at the other side of the picking part of the tuft picker. If more than one picker eye is arranged at the working surface of the picking part, the corresponding cover tools may also be designed to close the more than one picker eyes successively.

In addition to the hook of the cover tool, the main body of the cover tool is movable relative to the picker eye, too. In particular, the main body may be located partially above the picker eye in the first position of the cover tool and less partially or completely outside the area of the picker eye in the second position of the cover tool. That means the main bodies of the cover tools cover a part of the picker eye in the first position of the cover tool so that this part cannot be filled with filaments during a picking process. In particular, said part of the main bodies may cover the bottom of the picker eye. During movement of the cover tools from their first position into their second position the main body will be removed from the area of the picker eye thereby releasing the space covered before at least partially. That means filaments which are located inside the picker eye may be transferred deeper into the picker eye during the movement of the cover tools from their first into their second position.

In parallel to the movement of the main body out of the area of the picker eye the hook is moved from its location outside the building line of the working surface into the building lines of the working surface. Thereby the volume which is covered by the parts of the main body in the first position of the cover tools is identical or smaller to the volume covered by the hooks in the second position of the cover tools. Thus, the volume of the picker eye which can be filled with filaments is identical in both, the first and the second position of the cover tools or the volume of the picker eye is larger in the second position of the cover tools. If the volume of the picker eye is larger in the second position, the volume is increased such that the filaments are still securely hold in the picker eye, but the slightly increased volume simplifies transportation of the filaments deeper inside the picker eye.

The contour of the hook of the cover tools is adapted to transfer objects to be located inside the picker eye deeper into said picker eye. In particular, the second surface of the hook is adapted to transfer objects which are located inside the picker eye deeper into said picker eye. Thereby the second surface is adapted to transfer objects which are located inside the picker eye out of the building line of the working surface of the picking part, i.e. the opening of the picker eye. For example the hook may be sickle shaped. In addition or alternatively, the end of the hook may be rounded so that the end of the hook does not clamp or damage the filaments picked. In addition or alternatively, the second surface of the hook which is the surface which is located to the picker eye in the second position of the cover tool may be chamfered from the end, preferably the rounded end, of the hook to the base of the hook which is connected to the spacer of the cover tool. The width of the hook may increase from the end, preferable the rounded end, to the base of the hook at the connection to the spacer. A suitable width of the hook may be in the range from about 0.01 mm to about 0.1 mm at the end to about 0.1 mm to about 5 mm at the spacer, preferably from about 0.01 mm to about 0.05 mm at the end to about 0.2 mm to 1 mm at the spacer or any other numerical range which is narrower and which falls within such broader numerical range, as if such narrower numerical ranges were all expressly written herein.

In addition, the tuft picker may comprise a sandwich structure of picking parts and cover tools. For example, a second picking part may be arranged on top of one or both of the cover tools and an additional cover tool may be mounted to the second picking part. In the resulting sandwich structure picking parts and cover tools are arranged alternatively. If more than one picking part and more than one additional cover tools are arranged on top of each other it is important, that all components comprise the same picker eye which needs to be located at identical positions to each other. If additional picking parts and cover tools are arranged to a larger sandwich structure the part of the filaments that is covered by the picker eyes increases thereby decreasing the bending forces applied. A wider picker eye structure may be advantageous, if very small and/or damageable filaments are used. The number of additional picking parts and cover tools is not limited and is chosen according to the size and volume of the picker eye to be achieved.

In addition or alternatively, the picker eye can principally be of any geometrical form. The form of the picker eye may help to trap the filaments to be picked inside the picker eye. The internal surface of the picker eye may be regularly or irregularly. An irregular internal surface of the picker eye may be preferred as any movement of the filaments in the picker eye may be decreased thereby so that the picked filaments are easier stored inside the picker eye. Suitable forms of a picker eye are for example a circle, an oval, or a combination thereof. In particular, the picker eye may be an oval, wherein the depth of the picker eye is larger than the width of the picker eye. Said oblongness may help to pick filaments comprising at least one recess as well to keep the filaments in the picker eye during the movement of the tuft picker. For example, the picker eye may be an oval comprising a depth in the range of from about 0.5 mm to about 5 mm and a width in the range of from about 0.1 mm to about 3 mm, preferably a depth in the range of from about 1 mm to about 4 mm and a width in the range of from about 0.5 mm to about 1.5 mm or any other numerical range which is narrower and which falls within such broader numerical range, as if such narrower numerical ranges were all expressly written herein. Alternatively, the picker eye may be an oval wherein the width of the picker eye is larger than the depth of the picker eye. For example, the picker eye may be an oval comprising a width in the range of from about 1 mm to about 8 mm and a depth in the range of from about 0.4 mm to about 4 mm, preferably a width in the range of from about 1.5 mm to about 5 mm and a depth in the range of from about 0.5 mm to about 3 mm Said kind of picker eye may be in particular useful for tuft pickers comprising a straight working surface.

In addition or alternatively, the width of the picker eye may vary along the depth of the picker eye. That means the width at the bottom of the picker eye may be larger than the width of the opening of the picker eye. Variation of the width along the depth of the picker eye may help in keeping the filaments in the picker eye during the movement of the tuft picker. In addition or alternatively, the depth of the picker eye may be adapted between two successively performed working strokes or a predefined number of performed working strokes. By varying the depth of the picker eye, the size of the picker eye is varied. The size of the picker eye corresponds to the predefined number of filaments picked which form one filament tuft after picking. That means if the size of the picker eye is varied, different filament tufts can be picked with one tuft picker.

The opening of the picker eye may be reduced by two protrusions compared to the width of the picker eye itself. A top of the protrusions may be located in the working surface of the picking part so that the top of the protrusions may help to separate filaments from the filament container and may build a barrier in order to keep filaments which are already picked in the picker eye. Suitable protrusions limit the opening in the range of from about 0.025 mm to about 0.35 mm, preferably in the range of from about 0.5 mm to about 0.3 mm, more preferred from about 0.10 mm to about 0.25 mm or any other numerical range which is narrower and which falls within such broader numerical range, as if such narrower numerical ranges were all expressly written herein. That means the opening of the picker eye is smaller than the width of the picker eye outside the building line of the working surface, namely the width is reduced by the size of the protrusions. In particular, the picker eye may preferably comprise at least one protrusion protruding into the opening at the side of the opening where the end of the hook is located in the second position of the cover tool, i.e. where the end of the hook is located when it closes the opening of the picker eye. If the picker eye comprises a protrusion at said side the end of the hook may correspond to the form of said at least one protrusion in order to securely and firmly close the opening of the picker eye. In particular, the end of the hook may comprise the negative and/or opposite form of said at least one protrusion. In particular, the protrusion is designed such that a filament being separated from a filament container is automatically transferred deeper into the volume of the picker eye.

The contour of the working surfaces is adapted to be movable during a working stroke past an open side of a filament container. A "working stroke" as understood herein is any movement of the tuft picker which passes the opening of the picker eye along the loose filaments in a filament container, wherein filaments are transferred into the picker eye thereby being finally removed from the filament container. The contour of the working surfaces of a tuft picker may be straight or circular. That means a working stroke may be a linear movement or a circular movement depending on the contour of the tuft picker. Circular tuft picker are usually used in the prior art, but a linear tuft picker may also be suitable to be combined with the picker eye and the cover tools as disclosed herein. If the tuft picker is a circular arc the circular arc comprises preferably a curvature/diameter in the range from about 20 mm to about 200 mm, more preferred with a curvature/diameter in the range from about 40 mm to about 100 mm or any other numerical range which is narrower and which falls within such broader numerical range, as if such narrower numerical ranges were all expressly written herein.

During its movement the tuft picker may oscillate along a predefined form. For example, a linear tuft picker oscillates along a straight line and a curved tuft picker oscillates along a part of a circular art. Thereby the tuft picker oscillates from a starting position to a reversal point. During the movement of the tuft picker the cover tools are transferred from their first, i.e. open position into their second, i.e. closed position. In particular, the movement of the cover tools is faster than the movement of the tuft picker so that the cover tools reach their second position before the tuft picker reaches the reversal point. That means the opening of the picker eye is closed by the hooks of the cover tools before the tuft picker reaches the reversal point of its movement. Preferably, the cover tool is transferred from its first position into its second position near arriving the reversal point because the movement of the tuft picker is minimal near to the reversal point. During the movement of the tuft picker back into its starting position the cover tool may stay in its second position so that the opening of the picker eye is closed during said movement. As soon as the tuft picker has passed the loose filaments during its movement back or has reached again its starting position the cover tools can be moved back into its first position thereby opening the opening of the picker eye again. The filaments can be removed from the picker eye after first and/or second movement of the tuft picker.

Alternatively, the movement of the tuft picker may be unidirectional and continuously. For example the tuft picker may move rotate continuously. Suitable tuft picker for a rotational movement are circular arcs, circles or partial circles. Such a rotational movement may be combined with more than one picker eye so that the picking efficacy of the tuft picker is increased. For example, picker eyes with different sizes may be arranged at one tuft picker so that different filament tufts can be picked with one tuft picker. In addition or alternatively, the tuft picker may comprise picker eyes distributed over the whole working surface, or picker eyes may be grouped. The arrangement of more than one picker eye on a tuft picker may be e.g. adapted to the filament procession tools.

Linear tuft pickers with straight working surfaces may be also combined with more than one picker eye per tuft picker, wherein the picker eyes may be identical of different to each other. The linear movement of a linear tuft picker is usually an oscillating movement, wherein both movement directions may represent a working stroke, i.e. may pick up filaments from the filament container. If the tuft picker picks up filaments in both directions the picker eyes will be emptied at both sides of the filament container by a suitable filament processing tool. Alternatively, only one direction of the linear movement may represent a working stroke and the picker eyes may pass the filament container with closed cover tools in the reverse direction, wherein the picker eyes are still filled with filaments or already emptied.

In addition or alternatively, the present disclosure further provides a method of providing filament tufts for brush making production, in particular for toothbrush making production. Said filament tufts comprise a predefined number of filaments. A "predefined number of filaments" as understood herein mean a number which is set by the size of the picker eye of the tuft picker as disclosed herein and which is used in a picker device. Said predefined number may vary in the number of the selected and picked filaments in range of about 25% above or below the set number. The method comprises using at least a tuft picker, preferably as disclosed herein, and comprises further separating laterally the filaments from a quantity of loose fibers in order to form a filament tuft. The filaments to be picked comprise standard and non-standard filaments, such as super-thin filaments or tapered filaments or the filaments may comprise recesses, such as X-shaped filaments.

The method may comprise providing filaments in a filament container, wherein the filaments are continuously transferred against an open side of the filament container. Then, an opening of at least one picker eye is passed along said open side of the filament container in order to let filaments being transferred from the container into the picker eye. Then, the filaments which are located in the opening of the picker eye are removed from said opening by sliding the hooks of the cover tools in the building line of said opening. Thereby the filaments are securely and firmly stored inside the picker eye and can easily be transferred for further processing. Thus, the method further comprises the step of transferring the filaments located in the closed picker eye to a removal device, which removes the filaments from the picker eye for further processing. The cover tools open shortly before they arrive at the removal device by sliding the hooks out of the building line of the opening of the picker eye. In parallel to the hooks which are slid into and out of the building line of the opening of the picker eye a part of the main body of the cover tools cover more or less of the bottom of the picker eye. That means in the open position of the hooks a part of the main body of the cover tools is located over the bottom of the picker eye and said part is removed when the hooks slide into their closed position. If the hooks slide back into their open position, the part of the main part of the body of the cover tools is moved to cover the bottom of the picker eye again. As the volume which is covered by the part of the main body and the hook are identical the free space in the picker eye which can be filled with filaments is also identical independently of the position of the cover tools. Thus, the picked filaments are more or less clamped into the picker eye with continuous clamping force. Alternatively, the volume covered by the main part of the body of the cover tool is larger than the volume covered by the hook, so that the picker eye volume slightly increase by moving the cover tools from their first into their second position. The slightly increased volume of the picker eye makes it easier to remove the filaments from the openings of the picker eye. The increase in the volume of the picker eye will be small enough to hold the filaments in the picker eye firmly.

In addition or alternatively, the present disclosure further provides a brush, in particular a toothbrush comprising at least one filament tuft comprising at least one non-standard filament, e.g. filaments which circumference comprise at least one recess, such a X-shaped filaments, or filaments which are tapered or super-thin filaments. Said brush is manufactured using a method and/or a tuft picker as disclosed herein. Preferably, the brush and/or toothbrush produced comprise at least one filament tuft comprising X-shaped filaments.

In the following, a detailed description of several example embodiments will be given. It is noted that all features described in the present disclosure, whether they are disclosed in the previous description of more general embodiments or in the following description of example embodiments of the device, even though they may be described in the context of a particular embodiment, are of course meant to be disclosed as individual features that can be combined with all other disclosed features as long as this would not contradict the gist and scope of the present disclosure. In particular, all features disclosed for either one of the device or a part thereof may also be combined with and/or applied to the other parts of the device or a part thereof, if applicable.

FIG. 1 shows a schematic view of a tuft picking device 50 for brush making machines mounting filament tufts into a brush, in particular into a toothbrush. The tuft picking device 50 comprises at least a tuft picker 10 and a filament container 40. Further components which might belong to the tuft picking device 50 are not shown in order to facilitate FIG. 1. The filament container 40 is suitable for holding a plurality of loose filaments 42 in a mutually parallel condition. That means the filaments 42 are located with parallel length axes in the filament container 40, wherein the length axes of the filaments 42 are parallel to the side walls of the filament container 40. The filaments 42 may be for example monofilaments made from plastic material such as polyamide (PA), in particular PA 6.10 or PA 6.13. The diameter of the filament may be in the range from about 0.1 mm to about 0.5 mm or and the filaments may be cut into pieces of a length in the range of about 11 mm to about 46 mm.

The filament container 40 may be of any geometrical shape as long as the filaments 42 can be stored therein. For examples, the filament container 40 comprises two side walls which are immovable, one movable side wall and one open side. The movable side wall is located opposite to the open side and is moved into the direction of the open side, thereby moving the plurality of filaments 42 stored in the filament container 40 in the same direction. At the open side the filaments 42 are in contact with the tuft picker 10. The tuft picker 10 comprises at least one picker eye 20 which is suitable to take up filaments 42 from the filament container 40. The tuft picker 10 is attached to the tuft picking device 50 in such that the tuft picker 10 can be moved. The surface contour of the tuft picker 10 shown in FIG. 1 is a circular arc and the movement of the tuft picker 10 is a circular movement as well. A working stroke, meaning the movement of the tuft picker 10 that brings the picker eye 20 into contact with the filaments 42 located in the filament container 40 is a circular movement, in particular a oscillating movement. Preferably, the reversal point of the tuft picker 10 is located at the open side of the filament container 40. That means, the picker eye 20 may be e.g. moved up to the middle of the open side of the filament container 40, filled with filaments 42 and removed into the position outside the filament container 40 (as shown in FIG. 1). In the position outside the filament container 40 the filaments 42 can then be removed from the picker eye 20 in order to be mounted to a brush.

Figure 2A:
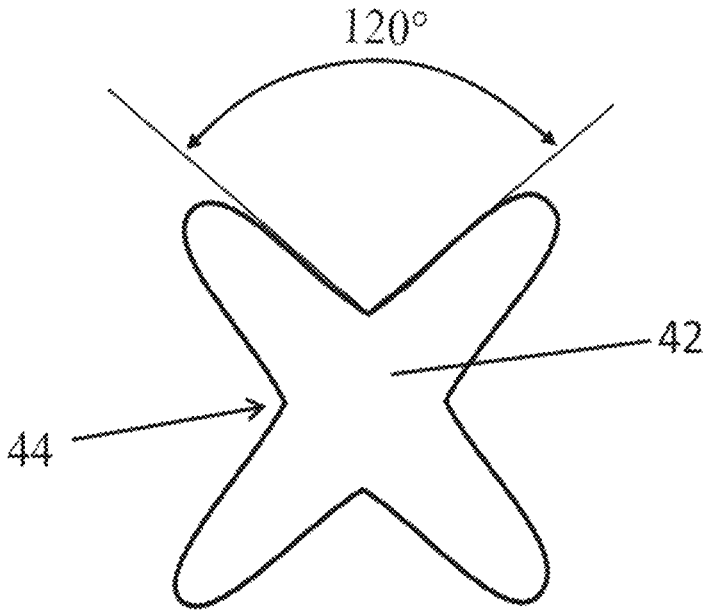
FIGS. 2A, 2B shows sectional views of a two different filament types 42 comprising four recesses 44 in their circumference (X-shaped) and different included angles.
Figure 2B:
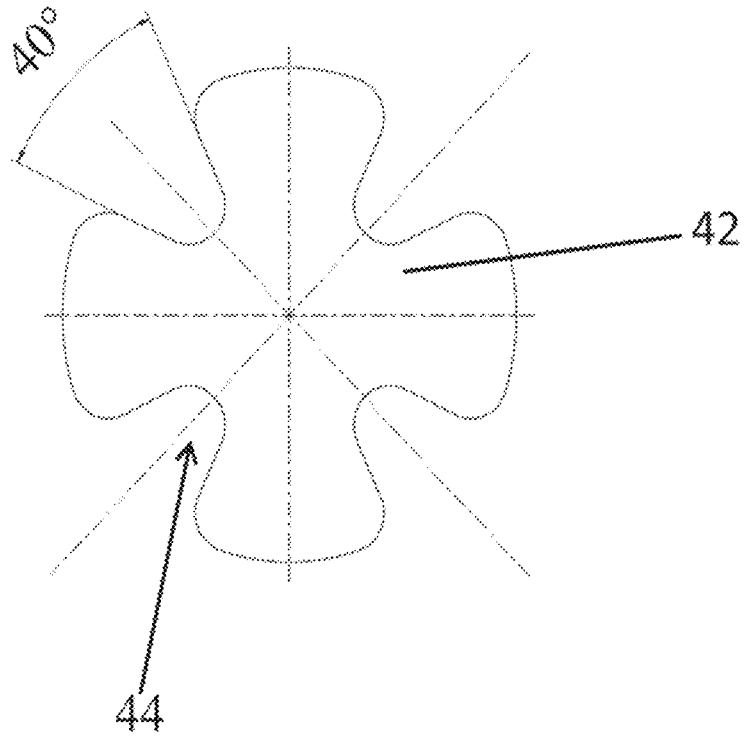

FIGS. 2A and 2B each show a schematic sketch of a filament 42 comprising four recesses 44 in its circumference. The four recesses 44 are arranged regularly around the circumference of the filament 42, thereby forming an X-shaped filament. Different forms and sizes of recesses are possible. The included angle of each of the recesses 44 of the X-shaped filament 42 may be in the range of from about 40° to about 160°. The included angle of the recesses 44 shown is about 120° in FIG. 2A and about 40° in FIG. 2B. The maximal dimension of the filament 42 may be in the range of from about 0.1 mm to about 0.5 mm. The depth of the recesses 44 is less than until the middle of the filament in order to have a robust bulk in the middle of the filament 42. A suitable depth of a recess 44 is in the range of about 0.025 mm to about 0.25 mm, preferably of about 0.04 mm to about 0.15 mm. The four recesses 44 may be equal to each other in form, shape, size and opening angle as shown or may be different to each other. Regarding X-shaped filaments 42 at least the two opposite recesses 44 are preferably equally formed compared to each other.

Figure 3A:
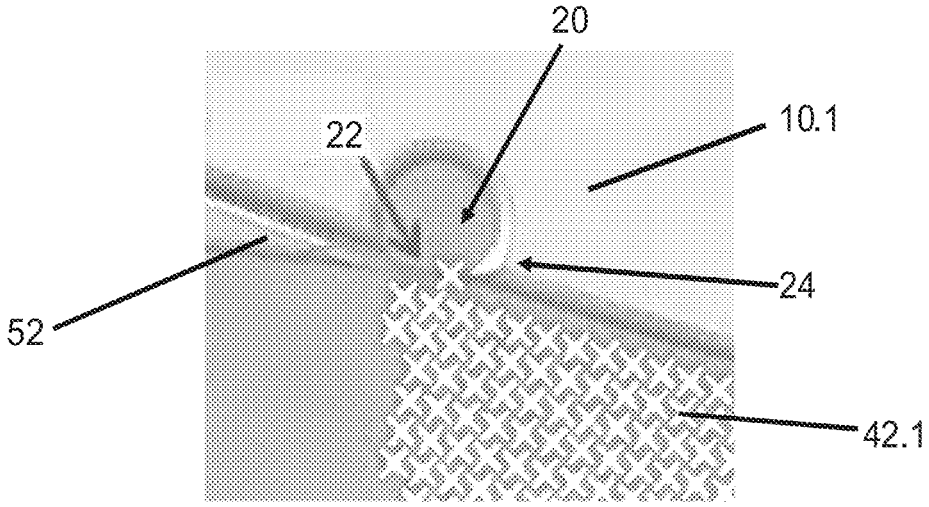
FIG. 3A Prior Art
FIG. 3A shows a schematic sketch of a conventional picker eye 20 splicing an X-shaped filament 42.1 by the sharp projection 24.
Figure 3B:
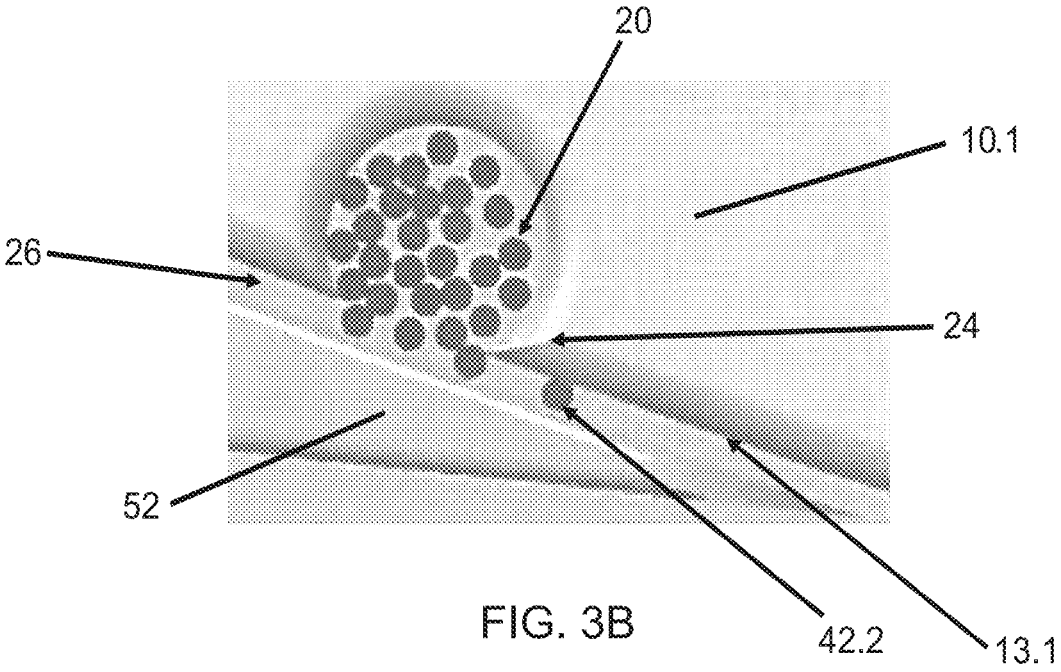
FIG. 3B Prior Art
FIG. 3B shows a schematic sketch of a conventional picker eye 20 clamping a super-thin filament 42.2 between a conventional tuft picker 10.1 and the counterpart 52.

FIG. 3 show schematically the problems which occur, if a standard tuft picker 10.1 is used for non-standard filaments, e.g. X-shaped filaments 42.1 (FIG. 3A) or super-thin filaments 42.2 (FIG. 3B). The X-shaped filaments 42.1 are transferred into the picker eye 20 during the movement of the tuft picker 10.1. Thereby X-shaped filaments 42.1 may be located in the opening 22 of the picker eye 20. These filaments 42.1 will be spliced by a sharp projection 24 as soon as the opening 22 of the picker eye 20 is moved along a counterpart 52 of the tuft picker 10.1. If super-thin filaments 42.2 are processed with a standard tuft picker 10.1 the filaments 42.2 will be clamped in the gap 26 between the working surface 13.1 of the tuft picker 10.1 and the counterpart 52 (FIG. 3B).

Figure 4:
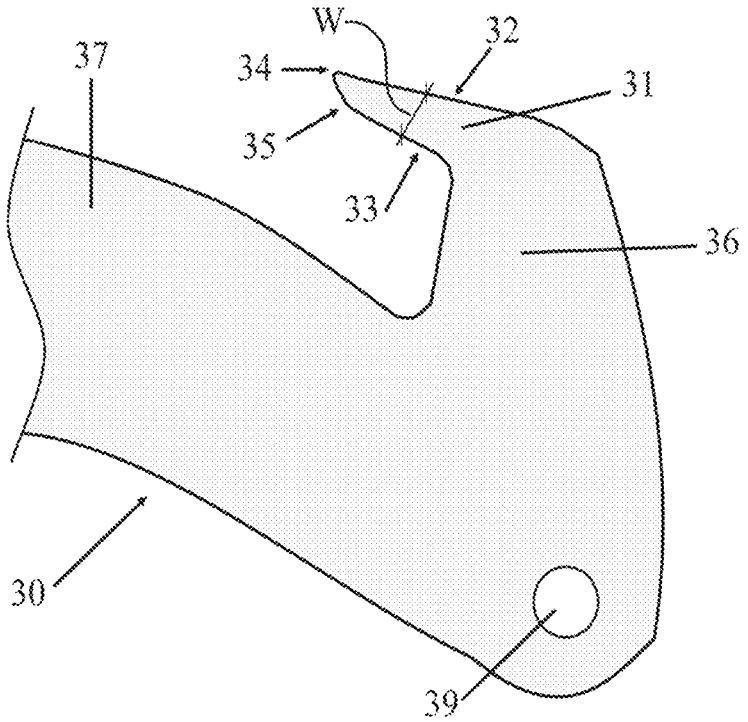
FIG. 4 shows a schematic view of the cover tool 30 mounted on both sides of the picking part 11 as shown in FIG. 5.

FIG. 4 shows a schematic view of the cover tool 30 mounted to both sides of a picking part 11 of a tuft picker as shown in FIG. 5. The cover tool 30 comprises a hook 31 which is connected via a spacer 36 to a main body 37. The cover tool 30 is mounted via a hinge 39 rotatable to the tuft picker. The hook 31 of the cover tool 30 comprises a first surface 32 and a second surface 33. The form of the first surface 32 corresponds to and is equal to the form of the working surface of the tuft picker. In particular, the form of the first surface 32 of the hook 31 is adapted to match the opening of the picker eye. The two surfaces 32, 33 of the hook 31 are connected via an end 34 which is rounded in order not to damage the filaments to be picked. The first and the second surface 32, 33 are spaced by a width W which increases from the end 34 towards the connection of the hook 31 to the spacer 36. A suitable width W at the rounded end 34 is about 0.05 mm and a suitable width W at the connection of the hook 31 to the spacer 36 is about 1 mm. The second surface 33 may be buckled so that a protuberance 35 arises in the second surface 33. The form of the hook 31 is optimized for transferring filaments which are located in the opening of a picker eye deeper into the free space of the picker eye.

Figure 5A:
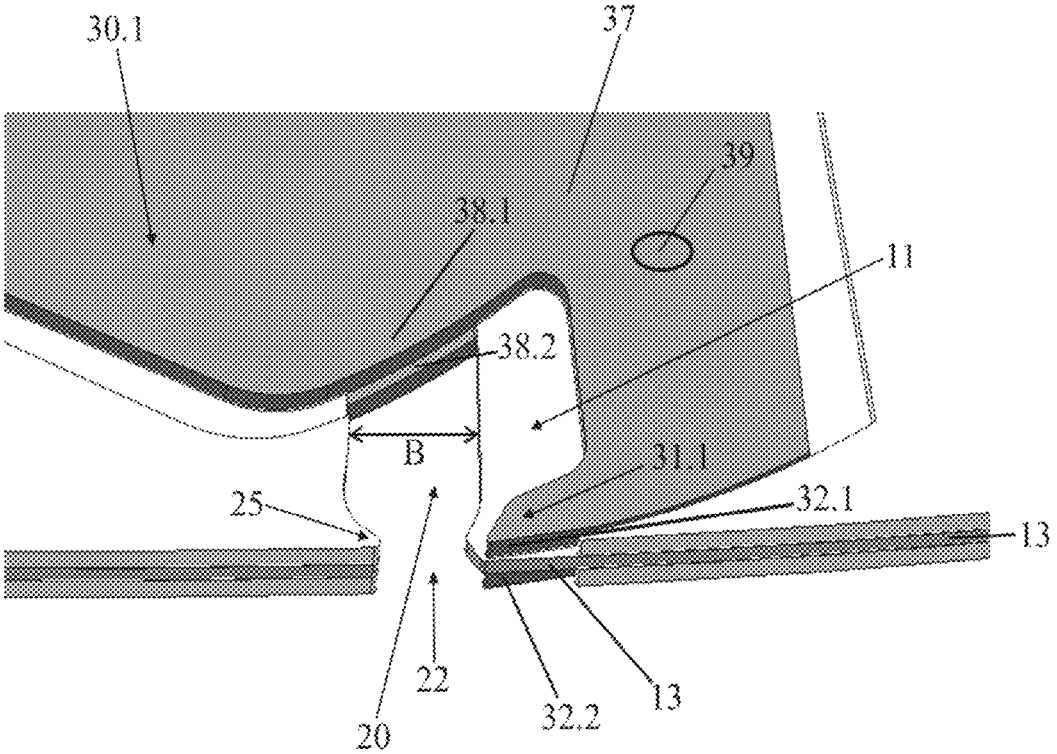
FIG. 5A shows a schematic sketch of a picker eye 20 comprising a picking part 11 and two cover tools 30.1, 30.2 which are spaced by the picking part 11.
Figure 5B:
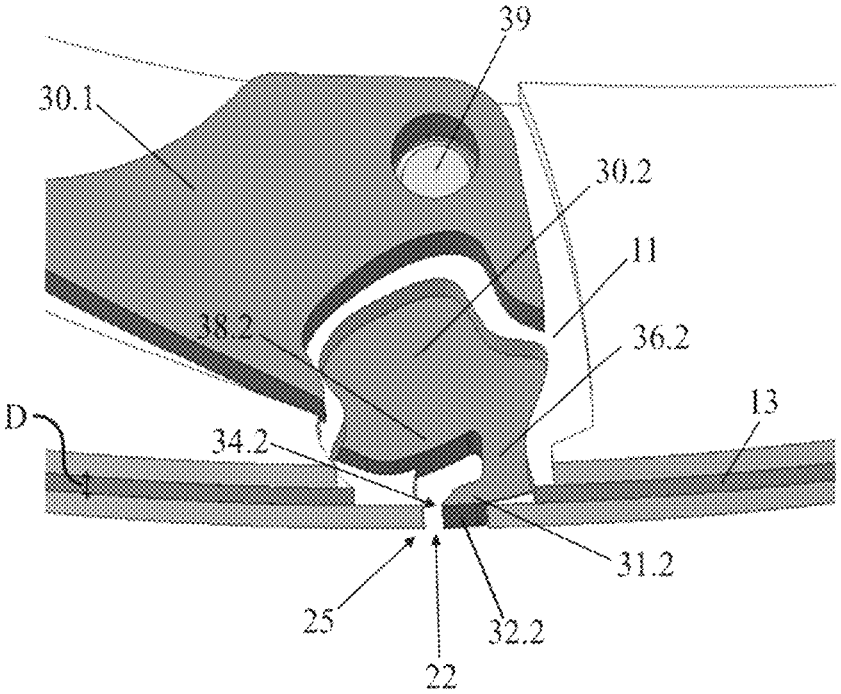
FIG. 5B shows the embodiment shown in FIG. 5A, wherein the first cover tool 30.1 was removed partly in order to show the sandwich structure and the second cover tool 30.2
Figure 5C:
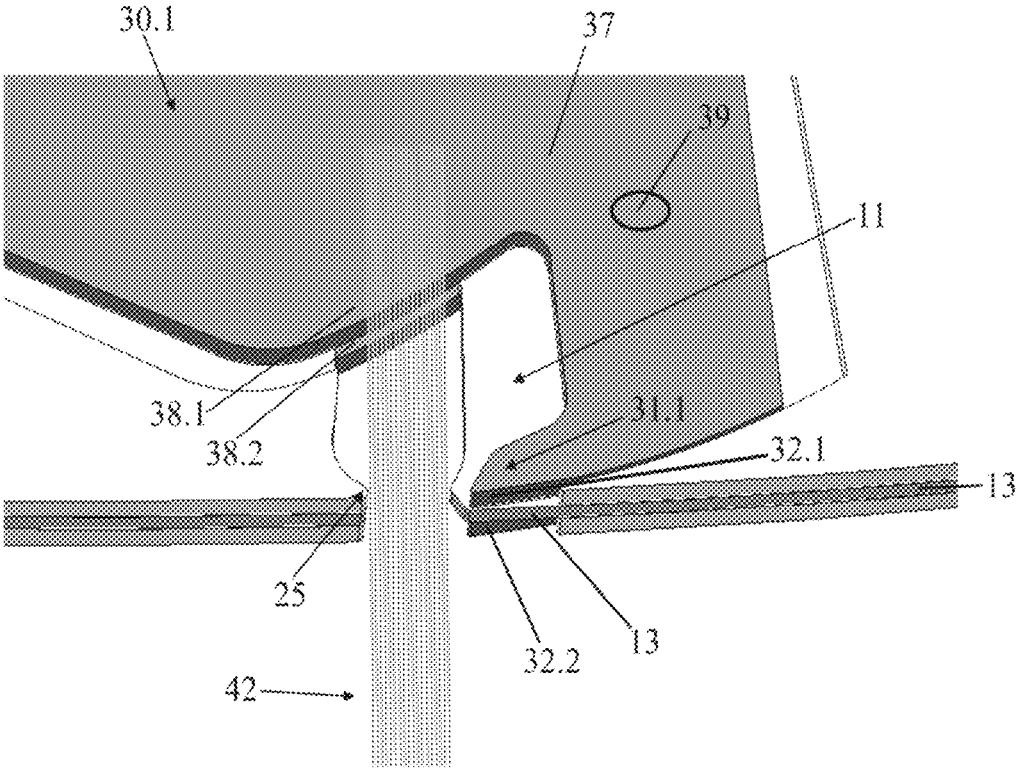
FIG. 5C shows a schematic sketch of the embodiment shown in FIG. 5A, wherein filaments 42 are located in the picker eye 20.
Figure 5D:
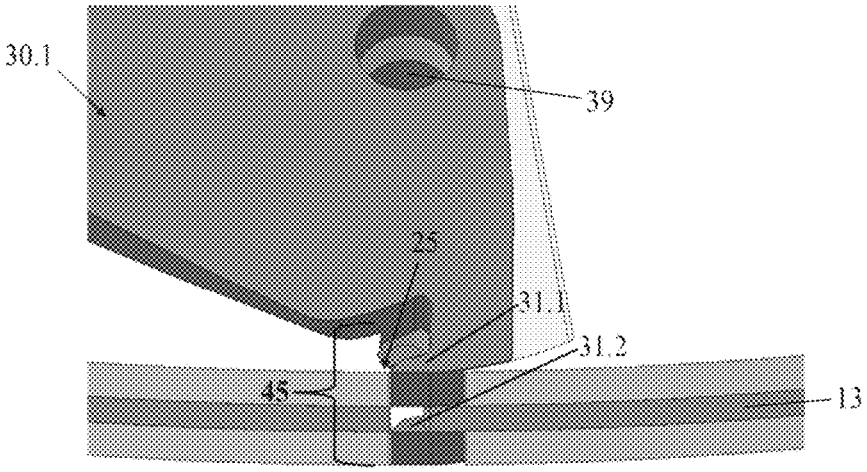
FIG. 5D shows a schematic sketch of the embodiment shown in FIG. 5A, wherein the picker eye 20 is closed by the hooks 31.1, 31.2 of the cover tools 30.

FIGS. 5A to 5D show a schematic front/top view of a cutting of an example embodiment of a tuft picker comprising picker eye cover tools 30 according to the present disclosure. The tuft picker comprises a picking part 11 and two cover tools 30.1, 30.2 which are located at both sides of the picking part 11 at identical positions relative to the picking part 11. That means the cover tools 30.1, 30.2 are spaced by a distance D which is identical to the thickness of the picking part 11. The picking part 11 of the tuft picker comprises a working surface 13 which is cut by an opening 22 of a picker eye 20. A depth L of the picker eye 20 extending from the opening 22 to a bottom 21 (see FIG. 6A) is larger than a width B. A suitable depth L is about 1.5 mm and a suitable width B is about 1.0 mm. The cover tools 30.1, 30.2 each comprise a hook 31.1, 31.2, wherein the first surface 32.1, 32.2 corresponds to the form of the working surface 13 at the opening 22 of the picker eye 20. FIG. 5A shows a top/front view and in FIG. 5B the upper cover tool 30.1 was partly removed in order to show the sandwich structure more easily. The picker eye 20 is intended to take filaments 42 during the picking process as shown in FIG. 5C. A part 38.1, 38.2 of the cover tools 30.1, 30.2 are located inside the volume of the picker eye 20 thereby limiting the volume which can be filled with filaments 42. The cover tools 30.1, 30.2 are arranged movable at the picking part 11, e.g. the cover tools 30.1, 30.2 are mounted via a hinge 39 to the picking part 11. FIG. 5D shows the hooks 31.1, 31.2 in their second position. Features which are in common with those shown in FIGS. 5A to 5C are designated with the same reference numerals and are not described in detail again. During their movements the hooks 31.1, 31.2 move from a position completely outside the building lines of the opening 22 of the picker eye 20 to a position in the building lines of the opening 22. In parallel the parts 38.1, 38.2 of the cover tools 30.1, 30.2 move out of the volume of the picker eye 20 covered in the open position so that the net volume of the picker eye 20 that is available for taking up filaments 42 is constant. Alternatively, the net volume of the picker eye 20 may slightly increase as the volume covered by the hooks 31.1, 31.2 may be smaller than the volume released by the parts 38.1, 38.2. A slightly increased net volume of the picker eye 20 makes it easier to transfer the filaments 42 out of the picker eye opening 22 deeper into the volume of the picker eye 20. In the second position of the cover tools 30.1, 30.2, the ends 34.1, 34.2 are in contact with a protrusion 25 which protrudes from the opposite side of the picker eye opening 22 into said opening 22, so that the opening is closed completely.

Figure 6:
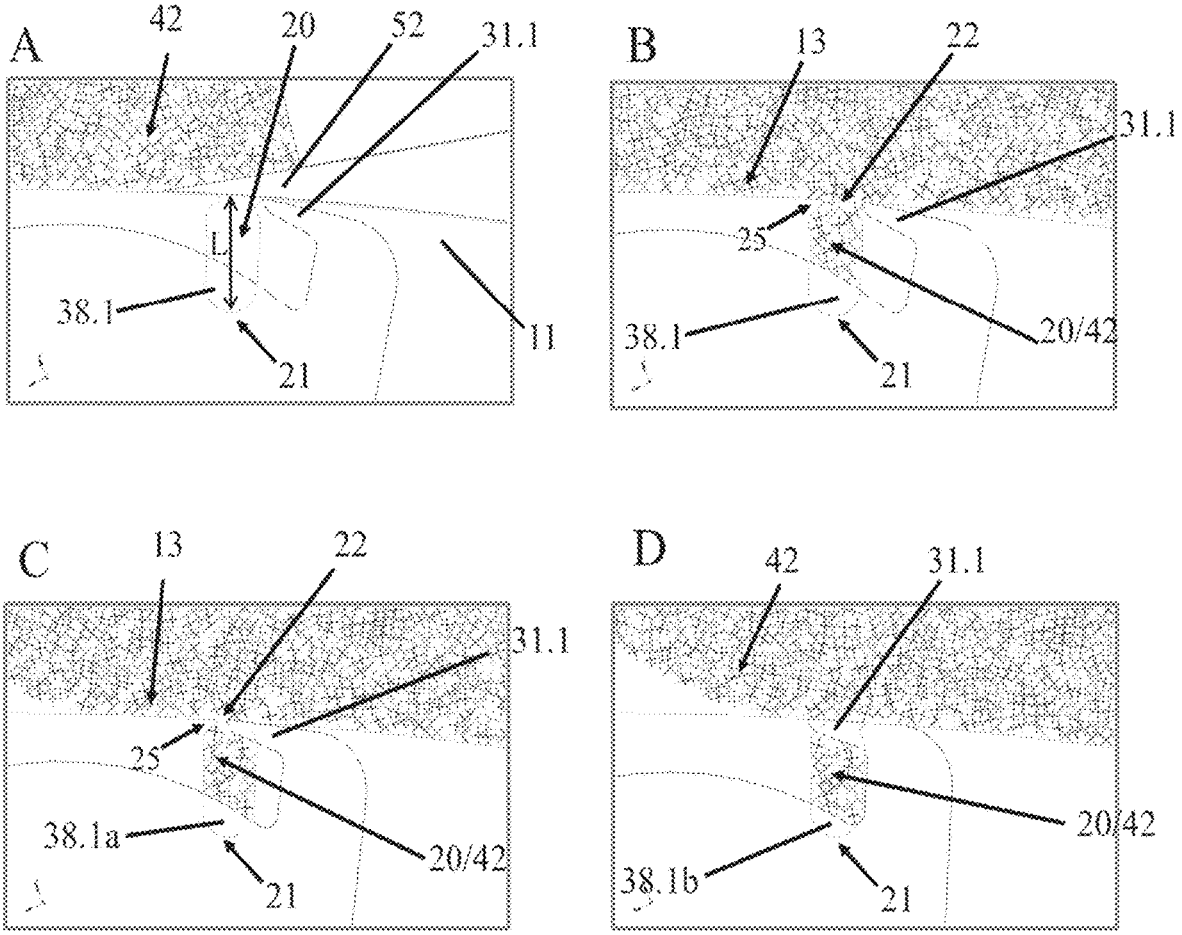
FIG. 6 show schematically in a partial top view the movement of the cover tool 30.1 from its first position into its second position, thereby closing a picker eye 20 comprising the filaments 42 with a hook 31.1.

FIG. 6 show schematically the movement of the upper/first cover tool 30.1 during one working cycle from its first position into its second position. Features which are in common with those shown in FIGS. 4 and 5 are designated with the same reference numerals and are not described in detail again. The second cover tool 30.2 is not shown in order to facilitate FIG. 6. The cover tool 30.1 is movable mounted to the picking part 11. The hook 31.1 is located outside the picker eye 20, in particular outside the building line of the opening 22 of the picker eye 20 (FIGS. 6A and 6B) in the first position of the cover tool 30.1. A part 38.1 of the main body of the cover tool 30.1 is located partly over the picker eye 20 so that said spaced covered by the part 38.1 cannot be filled with filaments 42. The opening 22 of the picker eye 20 is covered by a counterpart 52 of the tuft picker 10 so that the picker eye 20 cannot be filled (FIG. 6A). FIG. 6B shows the filaments 42 passing through the opening 22 into the picker eye 20, while the counterpart 52 (not shown) is located outside the area of the picker eye 20. Then the hook 31.1 is transferred from its first position outside the area of the picker eye 20 into its second position, wherein the hook 31.1 is located at the building line of the opening 22 (FIG. 6C). Thereby the filaments 42 are removed from the opening 22 and transferred deeper into the picker eye 20. In parallel the part 38.1 which is partly located over the bottom 21 of the picker eye 20 is partly removed from the picker eye 20. The volume which is released by the main part 38.1 of the cover tool 30.1 corresponds to the volume which is covered by the hook 31.1. FIG. 6D shows the hook 31.1 in its second position. The hook 31.1 is completely located in the building line of the opening 22 of the picker eye 20 thereby closing the picker eye 20. The part 38.1*b* of the main body which is still located in the area of the picker eye 2012 is the smallest compared to the part 38.1*b* which is located over the bottom 21 of the picker eye 20 during movement (FIG. 6C) and part 38.1 which is located over the bottom 21 when the cover tool 30.1 is located in its first position (FIG. 6A, 6B). The filaments 42 are securely located in the picker eye 20 (FIG. 6D) and can be transferred by the picker eye 20 to any further manufacturing step.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tuft picker (10) comprising a picking part (11) comprising at least one picker eye (20) with an opening (22) in a working surface (13) of the picking part (11) and a bottom (21) opposite to the opening (22);

a first cover tool (30.1) and a second cover tool (30.2) which are spaced from one another by the picking part (11), wherein each of the first and second cover tools (30.1, 30.2) comprises a hook (31.1, 31.2) is connected by a spacer (36) to a main body (37), wherein the hook (31.1, 31.2) comprises a first surface (32.1, 32.2) corresponding to the working surface (13) of the picking part (11) at the opening (22), wherein the hooks (31.1, 31.2) are located at identical positions relative to the picking part (11); and wherein the cover tools (30.1, 30.2) are movable relative to the picker eye (20) from a first position to a second position, wherein the hooks (31.1, 31.2) are located outside the picker eye (20) in the first position of the cover tools (30.1, 30.2) and in the second position of the cover tools (30.1, 30.2) so that they limit the picker eye (20) at a building line of the opening (22).

2. The tuft picker (10) of claim 1, wherein a part (38.1, 38.2) of the main body (37) of the first and second cover tool (30.1, 30.2) covers a part of the picker eye (20) including the bottom.

3. The tuft picker (10) of claim 2, wherein the part of the picker eye (20) that is covered is reduced by transferring the cover tools (30.1, 30.2) from their first position to their second position.

4. The tuft picker (10) of claim 2, wherein the part of the picker eye (20) which is covered in the first position of the cover tools (30.1, 30.2) is identical or larger than the part covered by the hooks (31.1, 31.2) in the second position of the cover tools (30.1, 30.2).

5. The tuft picker (10) of claim 1, wherein each of the hooks (30.1, 30.2) comprises a second surface (33) which is adapted to transfer objects to be located inside the picker eye (20) deeper into the picker eye (20) and thereby out of the building line of the working surface (13) at the opening (22), wherein an end (34.1, 34.2) of the hooks (31.1, 31.2) is rounded and the second surface (33) is chamfered from the end (34.1, 34.2) to the spacer (36).

6. The tuft picker (10) of claim 5, wherein a width (W) of the hooks (31.1, 31.2) increases from the end (34.1, 34.2) to the spacer (36), from about 0.01 mm to about 0.1 mm at the end (34.1,34.2) to about 0.1 mm to about 5 mm at the spacer (36).

7. The tuft picker (10) of claim 5, wherein the second surface (33) of the hooks (31.1, 31.2) comprises a protuberance (35) formed by buckling of the second surface (33).

8. The tuft picker (10) of claim 1, wherein the working surface (13) of the picking part (11) is a circular arc having a curvature diameter from 20 mm to 200 mm.

9. The tuft picker (10) of claim 1, wherein the opening (22) of the picker eye (20) is smaller than a width (B) of the picker eye (20), wherein at least one protrusion (25) protrudes into the opening (22) at the side of the opening (22) where the ends (34.1, 34.2) of the hooks (31.1, 31.2) are located in the second position of the cover tools (30.1, 30.2).

10. The tuft picker (10) of claim 9, wherein the ends (34.1, 34.2) of the hooks (31.1, 31.2) correspond to a form of the at least one protrusion (25), wherein the ends (34.1, 34.2) of the hooks (31.1, 31.2) comprise a negative/opposite form of the at least one protrusion (25).

11. The tuft picker (10) of claim 1, wherein the picker eye (20) has a form of a circle or an oval having a depth (L) from 0.5 mm to 5 mm and a width (B) from 0.1 mm to 3 mm.

12. The tuft picker (10) of claim 1, wherein the picker eye (20) has a form of an oval with a width (B) from 1 mm to 8 mm and a depth (L) from 0.4 mm to 4 mm.

13. The tuft picker (10) of claim 1, wherein the tuft picker (10) is structured and configured to oscillate along a part of a circular arc from a starting position to a reversal point, wherein the cover tools (30.1, 30.2) are transferred from their first position into their second position before the tuft picker (10) reaches the reversal point.

14. The tuft picker (10) of claim 13, wherein the cover tools (30.1, 30.2) stay in their second position during the tuft picker (10) oscillating back to its starting position.

15. A method of providing filament tufts comprising a predefined number of filaments (42) for the manufacturing of brushes, using a tuft picker (10) of claim 1, the method comprising:

providing filaments (42) in a filament container (40), wherein the filaments (42) are continuously transferred against an open side of the filament container (42);

passing at least one opening (22) of at least one picker eye (20) of a tuft picker (10) according to anyone of claims 1 to 14 along the open side of the filament container (40) in order to let filaments (42) being transferred from the container (40) into the picker eye (20);

removing filaments (42) from the opening (22) of the at least one picker eye (20) by sliding the hooks (31.1, 31.2) of the cover tools (30.1, 30.2) from their first position into their second position; and transferring the filaments (42) located in the closed picker eye (20) to a removal device, which removes the filaments (42) from the picker eye (20).

* * * * *